US009950354B2

(12) United States Patent
Elder et al.

(10) Patent No.: US 9,950,354 B2
(45) Date of Patent: Apr. 24, 2018

(54) BENDER SHOE RATCHET

(71) Applicant: Southwire Company, LLC, Carrollton, GA (US)

(72) Inventors: Doyle Wayne Elder, Arapaho, OK (US); Jesse Kay Davis, Fairview, OK (US)

(73) Assignee: Southwire Company, LLC, Carrollton, GA (US)

( * ) Notice: Subject to any disclaimer, the term of this patent is extended or adjusted under 35 U.S.C. 154(b) by 0 days.

(21) Appl. No.: 15/096,309

(22) Filed: Apr. 12, 2016

(65) Prior Publication Data

US 2017/0291206 A1 Oct. 12, 2017

(51) Int. Cl.
*B21D 7/06* (2006.01)

(52) U.S. Cl.
CPC ..... *B21D 7/063* (2013.01)

(58) Field of Classification Search
CPC ..... B21D 7/02; B21D 7/021; B21D 7/022; B21D 7/024; B21D 7/063
See application file for complete search history.

(56) References Cited

U.S. PATENT DOCUMENTS 8,991,229 B1 * 3/2015 Cheng ..... B21D 7/024 72/149
9,073,108 B2 7/2015 Elder
9,283,605 B2 * 3/2016 Plummer ..... B21D 7/024

* cited by examiner

*Primary Examiner* — Debra Sullivan
(74) *Attorney, Agent, or Firm* — Merchant & Gould P.C.

(57) ABSTRACT

A bender shoe may comprise a first bender shoe plate, a second bender shoe plate, and a third bender shoe plate. A first side of the first bender shoe plate may be adjacent to a first side of the second bender shoe plate and the third bender shoe plate may be adjacent to a second side of the second bender shoe plate. The bender shoe may further comprise a ratcheting gear in a ratcheting gear opening in a second side of the first bender shoe plate. The bender shoe may comprise a first channel and a second channel. The first channel may be formed by a first surface on the first bender shoe plate and a second surface on the second bender shoe plate. The second channel may be formed by a third surface on the second bender shoe plate and a fourth surface on the third bender shoe plate.

13 Claims, 8 Drawing Sheets

BENDER SHOE RATCHET

BACKGROUND

An electrical conduit is a tube used to protect and route electrical wiring in a building or non-building structure. Electrical conduit may be made of metal, plastic, fiber, or fired clay. Most conduit is rigid, but flexible conduit is used for some purposes. Conduit is generally installed by electricians at the site of installation of electrical equipment. Its use, form, and installation details are often specified by wiring regulations, such as the US National Electrical Code (NEC) and other building codes.

BRIEF DESCRIPTION OF THE FIGURES

The accompanying drawings, which are incorporated in and constitute a part of this disclosure, illustrate various embodiments of the present disclosure. In the drawings.

DETAILED DESCRIPTION

Overview

Figure 1:
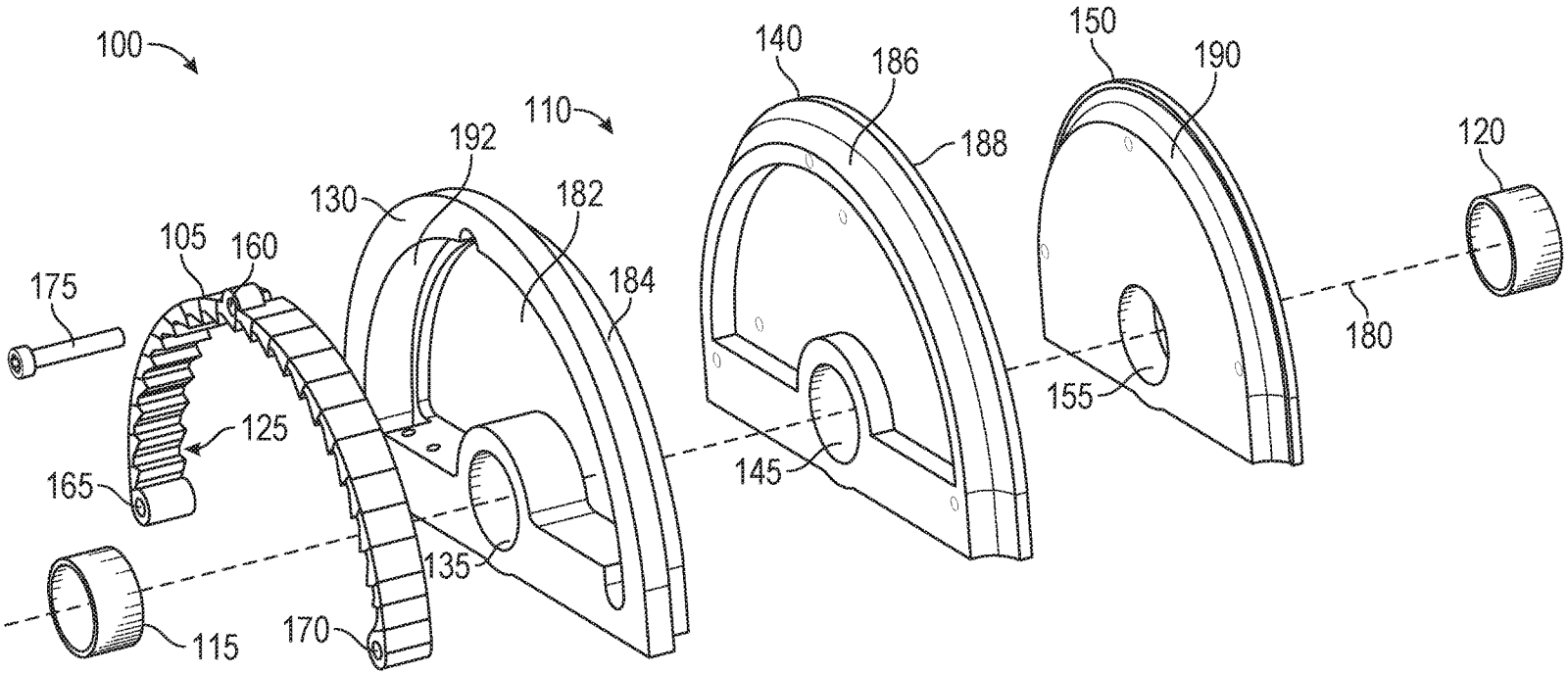
FIG. 1 shows a bender shoe.

A bender shoe may be provided. The bender shoe may comprise a plurality of bender shoe plates. The plurality of bender shoe plates may comprise a first bender shoe plate, a second bender shoe plate, and a third bender shoe plate. A first side of the first bender shoe plate may be adjacent to a first side of the second bender shoe plate and the third bender shoe plate may be adjacent to a second side of the second bender shoe plate. The bender shoe may further comprise a ratcheting gear disposed in a ratcheting gear opening in a second side of the first bender shoe plate. The bender shoe may also comprise a first channel and a second channel. The first channel may be formed by a first surface on the first bender shoe plate and a second surface on the second bender shoe plate. The second channel may be formed by a third surface on the second bender shoe plate and a fourth surface on the third bender shoe plate.

Both the foregoing overview and the following example embodiments are examples and explanatory only, and should not be considered to restrict the disclosure's scope, as described and claimed. Further, features and/or variations may be provided in addition to those set forth herein. For example, embodiments of the disclosure may be directed to various feature combinations and sub-combinations described in the example embodiments.

Example Embodiments

The following detailed description refers to the accompanying drawings. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims.

Embodiments of the disclosure may comprise a bender system for conduit. The conduit may comprise, but is not limited to, rigid conduit for example. Consistent with embodiments of the disclosure, the bender system may be mounted to a cart to provide a mobile bending workstation used for bending and working with, for example, rigid conduit in ¾ inch and 1 inch trade sizes. The bender system may be non-powered and may utilize a ratcheting mechanism built into a bending shoe. Embodiments of the disclosure may include the use of a lever with sufficient leverage for an average-sized user to easily bend the conduit. The cart may provide the bender system with a good ergonomic height and may facilitate measuring, storing conduit, storing tools, storing supplies, and may aid in clamping the conduit for cutting and threading operations. The cart may include casters and wheels in order to be easily moved.

FIG. 1 shows an exploded view of a bender shoe 100. As shown in FIG. 1, bender shoe 100 may comprise a ratcheting gear 105, a plurality of bender shoe plates 110, a first bushing 115, and a second bushing 120. Ratcheting gear 105 may comprise a plurality of ratchet teeth 125. Plurality of ratchet teeth 125 may be 28 and may range between 15 and 50, for example. The more ratchet teeth, the position there are. For example, ratcheting gear 105 maybe cut from steel plate rather than from cast iron. Consequently, plurality of ratchet teeth 125 may be made small, but still have the desired strength. While FIG. 1 shows bender shoe 100 comprising plurality of bender shoe plates 110, bender shoe 100 may be made of one piece.

Plurality of bender shoe plates 110 may comprise a first bender shoe plate 130 with a first bender shoe plate opening 135, a second bender shoe plate 140 with a second bender shoe plate opening 145, and a third bender shoe plate 150 with a third bender shoe plate opening 155. First bender shoe plate opening 135, second bender shoe plate opening 145, and third bender shoe plate opening 155 may each have a circular shape.

Ratcheting gear 105 may further comprise a plurality of fasten openings (e.g., a first fasten opening 160, a second fasten opening 165, and a third fasten opening 170) through which a plurality of fasteners may be deployed to fasten ratcheting gear 105 and plurality of bender shoe plates 110 together. For example, a first fasteners 175 (e.g., a bolt) may be deployed in first fasten opening 160, passed through first bender shoe plate 130 and second bender shoe plate 140, and attached to third bender shoe plate 150.

First bushing 115 may be placed snuggly in first bender shoe plate opening 135. Similarly, second bushing 120 may be placed snuggly in third bender shoe plate opening 155. In other embodiments, a single bushing may be placed snuggly in first bender shoe plate opening 135, second bender shoe plate opening 145, and third bender shoe plate opening 155. First bushing 115 and second bushing 120 may comprise right cylinders with concentric right cylindrical openings in the middle.

Ratcheting gear 105 and plurality of bender shoe plates 110 may each be arc-shaped and symmetric to a bender shoe axis 180 passing through the centers of first bender shoe plate opening 135, second bender shoe plate opening 145, and third bender shoe plate opening 155. Ratcheting gear 105 may be arc-shaped and may fit within a ratcheting gear opening 182 in first bender shoe plate 130 when bender shoe 100 is assembled. Furthermore, first bender shoe plate 130 may comprise a first surface 184. Second bender shoe plate 140 may comprise a second surface 186 that may be complementary to first surface 184. Second bender shoe plate 140 may also comprise a third surface 188 and third bender shoe plate 150 may comprise a fourth surface 190. Third surface 188 may be complementary to fourth surface 190. First surface 184, second surface 186, third surface 188, and fourth surface 190 may each be arc-shaped and may form a plurality of arc-shaped channels once bender shoe 100 is assembled as will be described in greater detail below. Ratcheting gear opening 182 may have an arc-shaped interior surface 192 against which ratcheting gear 105 may fit adjacent to as shown in greater detail below with respect to FIG. 2.

Figure 2:
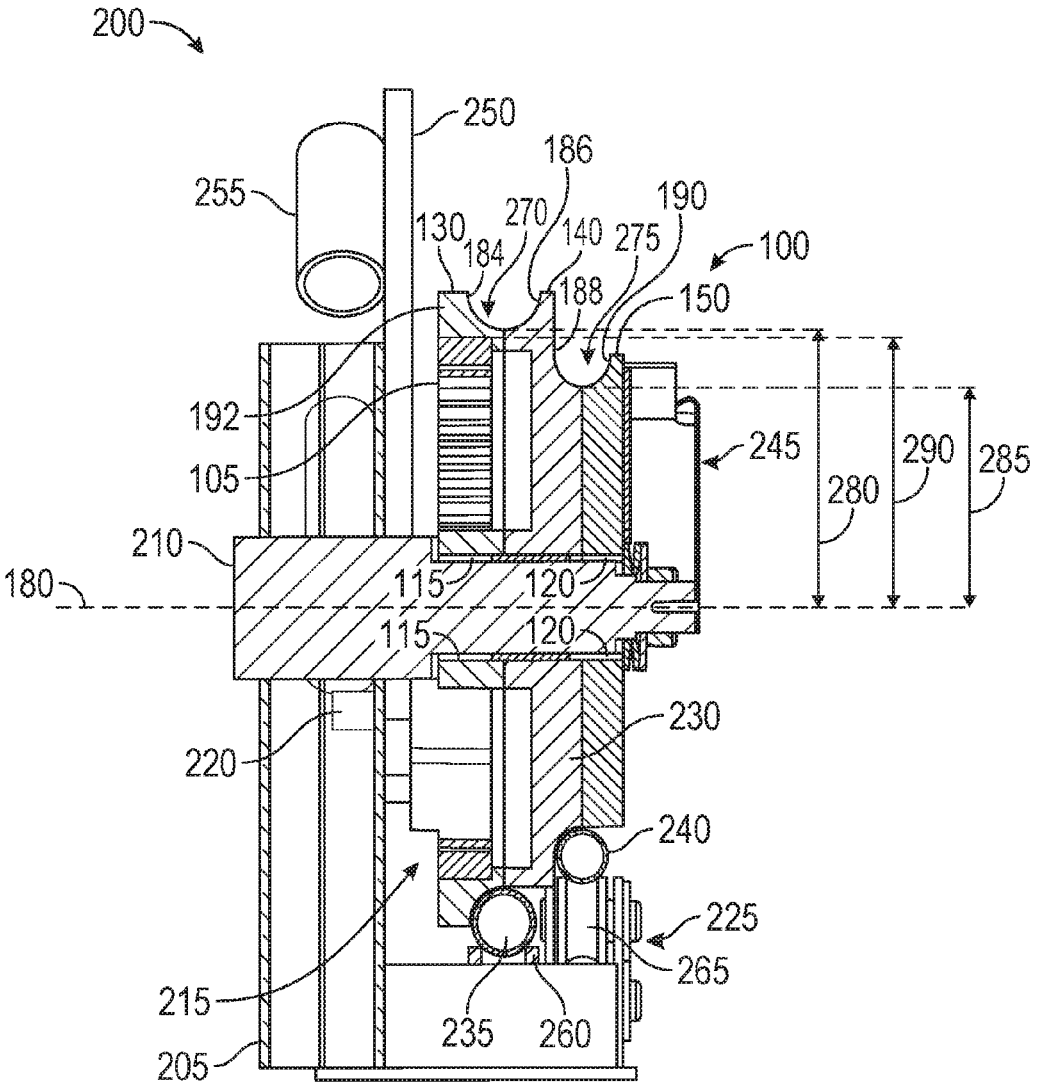
FIG. 2 shows a bender system.

FIG. 2 shows a bender system 200 in which bender shoe 100 may be disposed. As shown in FIG. 2, bender system 200 may comprise a mounting plate 205, a bender shoe pivot 210, a handle assembly 215, and a handle pivot 220. A roller assembly 225 and hook assembly 230 may also be included in bender system 200. Bender system 200 may be used to bend a first conduit 235 or a second conduit 240 individually or simultaneously. Angular measurement assembly 245 may be used to measure the amount of bend placed on first conduit 235 or second conduit 240.

Bender shoe pivot 210 may mount to mounting plate 205 and be symmetrical to bender shoe axis 180 once bender shoe 100 is mounted on bender shoe pivot 210. Bender shoe axis 180 may be perpendicular to vertical surfaces of mounting plate 205. Interior surfaces of first bushing 115 and second bushing 120 may slide against bender shoe pivot 210 when bender shoe 100 is rotated about bender shoe axis 180. In this way first bushing 115 and second bushing 120 may wear during bender system 200's operation rather than interior surfaces of first bender shoe plate opening 135, second bender shoe plate opening 145, or third bender shoe plate opening 155.

First bushing 115 and second bushing 120 may comprise replaceable filament-wound graphite wear bushings. Bender shoe pivot 210 may be hard-chromed. Accordingly, the wear surfaces between first bushing 115 and second bushing 120 and bender shoe pivot 210 may not need to be lubricated. Furthermore, when worn, first bushing 115 and second bushing 120 may be replaced rather than having to replace first bender shoe plate 130, second bender shoe plate 140, or third bender shoe plate 150.

Handle pivot 220 may mount to mounting plate 205. Handle assembly 215 may mount on handle pivot 220 and may comprise a handle 250 and a lever attachment 255. Roller assembly 225 may mount to mounting plate 205 and may comprise a plurality of rollers. For example, the plurality of rollers may comprise, but are not limited to, a first roller 260 and a second roller 265.

As stated above with respect to FIG. 1, the plurality of arc-shaped channels may be formed by bender shoe 100. The plurality of arc-shaped channels may comprise a first channel 270 and a second channel 275. First channel 270 may be formed by first surface 184 and second surface 186 when bender shoe 100 is assembled. Similarly, second channel 275 may be formed by third surface 188 and fourth surface 190 when bender shoe 100 is assembled. First channel 270 and second channel 275 may respectively be sized to accommodate certain sized conduits. For example, first channel 270 may be sized to accommodate 1 inch conduit and second channel 275 may be sized to accommodate ¾ inch conduit. First conduit 235 may fit snuggly between first roller 260 and first channel 270. Similarly, second conduit 240 may fit snuggly between second roller 265 and second channel 275.

First channel 270 may be arc-shaped and may be symmetrical about bender shoe axis 180. A first radius 280 may be measured from the bottom of first channel 270 to bender shoe axis 180. Second channel 275 may be arc-shaped and may be symmetrical about bender shoe axis 180. A second radius 285 may be measured from the bottom of second channel 275 to bender shoe axis 180. A third radius 290 may be measured from arc-shaped interior surface 192 to bender shoe axis 180. First radius 280 may be greater than second radius 285. Third radius 290 may be less than first radius 280 and greater than second radius 285. For example, first radius 280 may comprise 5.4 inches, second radius 285 may comprise 4.24 inches, and third radius 290 may comprise 5.23 inches.

Figure 3:
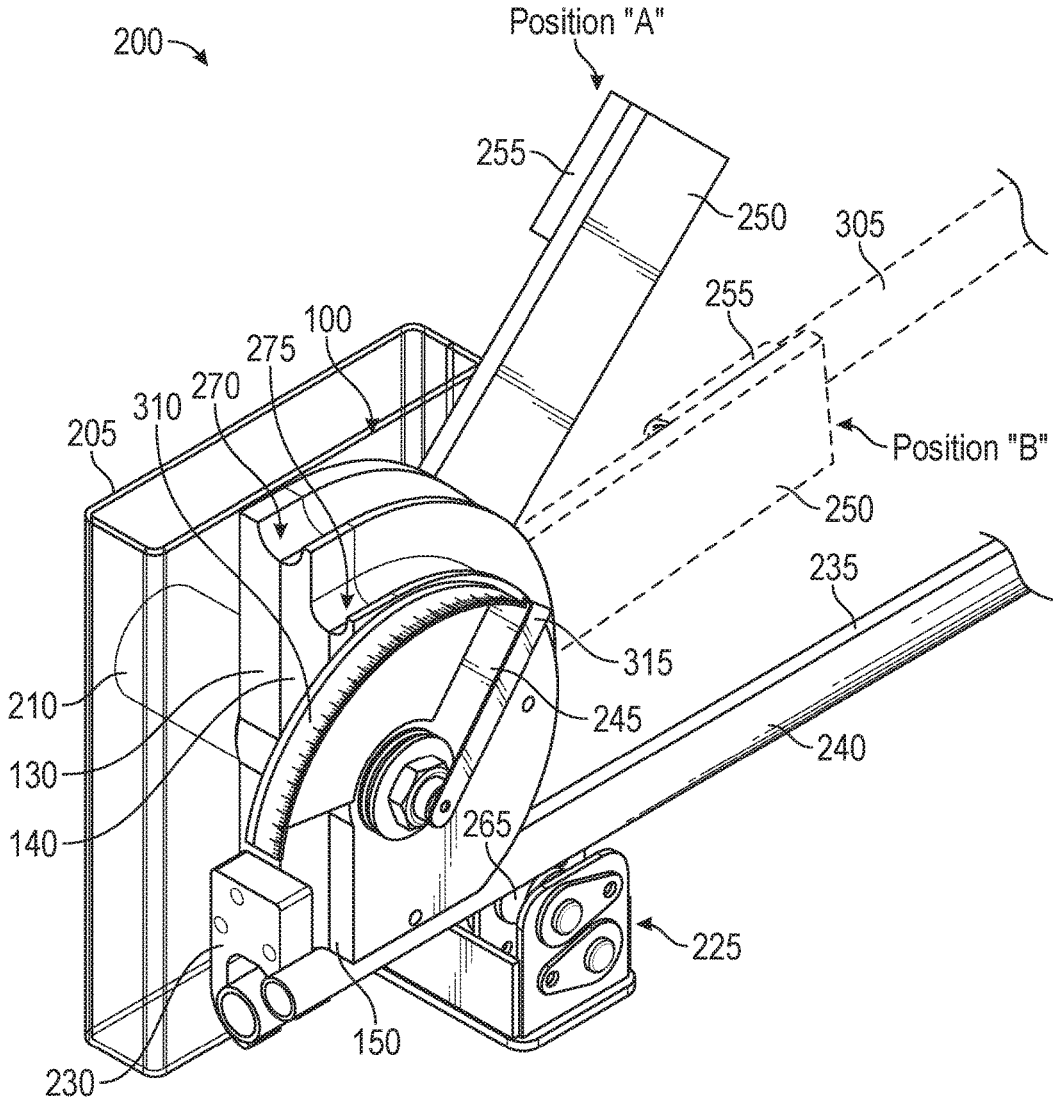
FIG. 3 shows a bender system.

As shown in FIG. 3, bending shoe 100 may be mounted so that the axis of rotation about bender shoe axis 180 may be selectively oriented as a lever 305 is placed in lever attachment 255 and used to move handle 250 from a first position "A" to a second position "B". As shown in FIG. 3, angular measurement assembly 245 may comprise an angular indicia 310 and a pointer 315. Angular indicia 310 may be provided with graduations in angular increments, such as degrees. Pointer 315 may be fixed in rotation with bending shoe 100 to extend to angular indicia 310. Angular indicia 310 and pointer 315 may be arranged so that, for example, pointer 315 may indicate "0" on angular indicia 310 when a straight piece of conduit (e.g., first conduit 235 or second conduit 240) is loaded in bender system 200 between roller assembly 225 hook assembly 230. Pointer 315 may move from "0" to "45", for example, on angular indicia 310 after a 45 degree bend has been imparted on the conduit by bender system 200 when handle 250 has been ratcheted from position "A" to position "B" a plurality of times. Accordingly, pointer 315 may provide a visual indicator of the amount of bend imparted on the conduit (e.g., first conduit 235 or second conduit 240) by bender system 200.

Figure 4B:
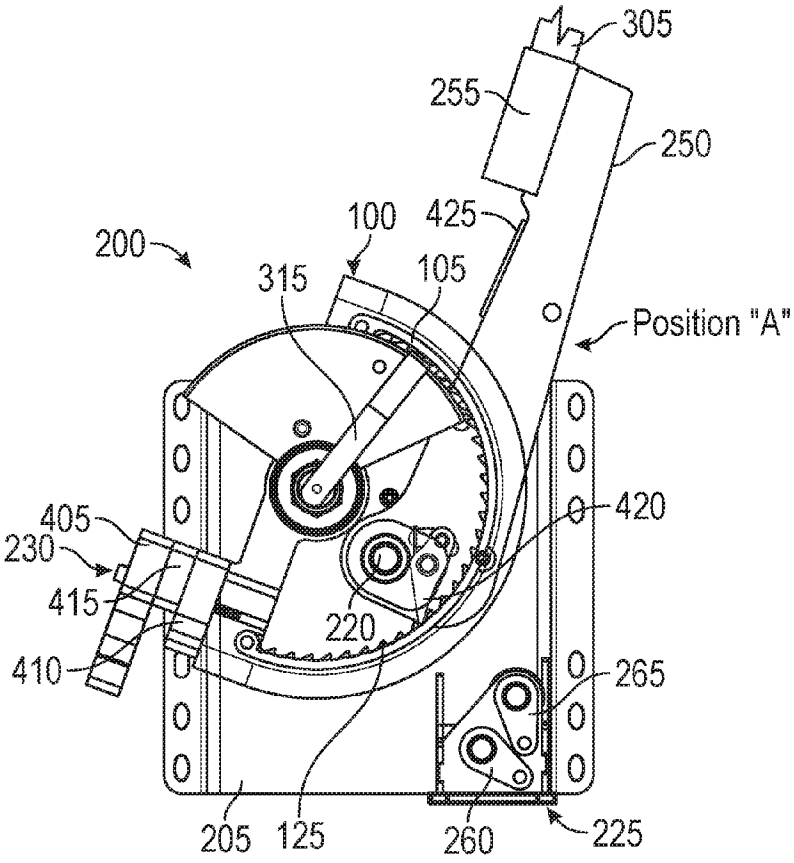
FIG. 4A and FIG. 4B show a bender system.
Figure 4A:
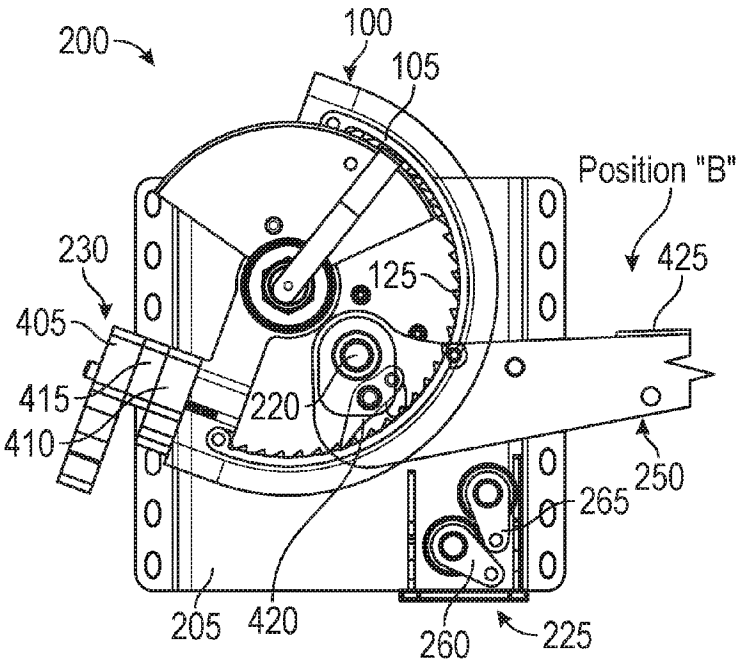

FIG. 4A shows bender system 200 with handle 250 in second position "B" and FIG. 4B shows bender system 200 with handle 250 in first position "A". As shown in FIG. 4A and FIG. 4B, hook assembly 230 may comprise a plurality of hooks. For example, the plurality of hooks may comprise, but are not limited to, a first hook 405 and a second hook 410. A hook spacer 415 may be disposed between first hook 405 and second hook 410. First conduit 235 may be hooked to first hook 405 to cause first conduit 235 to fit snuggly between first roller 260 and first channel 270. Similarly, second conduit 240 may be hooked to second hook 410 to cause second conduit 240 to fit snuggly between second roller 265 and second channel 275.

Handle assembly 215 may comprise a ratchet pawl 420 and a ratchet release lever 425. Consistent with embodiments of the disclosure, when lever 305 is used to move handle 250 from position "A" to position "B", ratchet pawl 420 may bite against a steep edge of one of plurality of ratchet teeth 125 thus transferring a downward motion of handle 250 to a rotational motion of bending shoe 100. Then the lever 305 may be lifted up to move handle 250 back toward position "A". As handle 250 moves back toward position "A", ratchet pawl 420 may slide over a long edge of one or more of plurality of ratchet teeth 125. A user operating lever 305 may decide to stop ratchet pawl 420 at an intermediate point between position "B" and position "A" on the upward stroke of lever 305. Also the use may not go all the way back down fully to position "B" on the downward stroke of lever 305. For example, as handle 250 is moved from fully down in position "B" to fully up in position "A", ratchet pawl 420 may traverse four of plurality of ratchet teeth 125. Ratchet pawl 420 may traverse any number of plurality of ratchet teeth 125 and is not limited to traversing four of plurality of ratchet teeth 125 as handle 250 moves from fully down in position "B" to fully up in position "A". Providing more teeth in plurality of ratchet teeth 125 may give the user more positions to "click" through between fully down in position "B" to fully up in position "A". In this way, the user may take smaller bites when bending conduit to provide an easier experience in bending conduit. The user may have to take more strokes to make a bend, but the strokes may be shorter, which may improve the user's experience.

Figure 5:
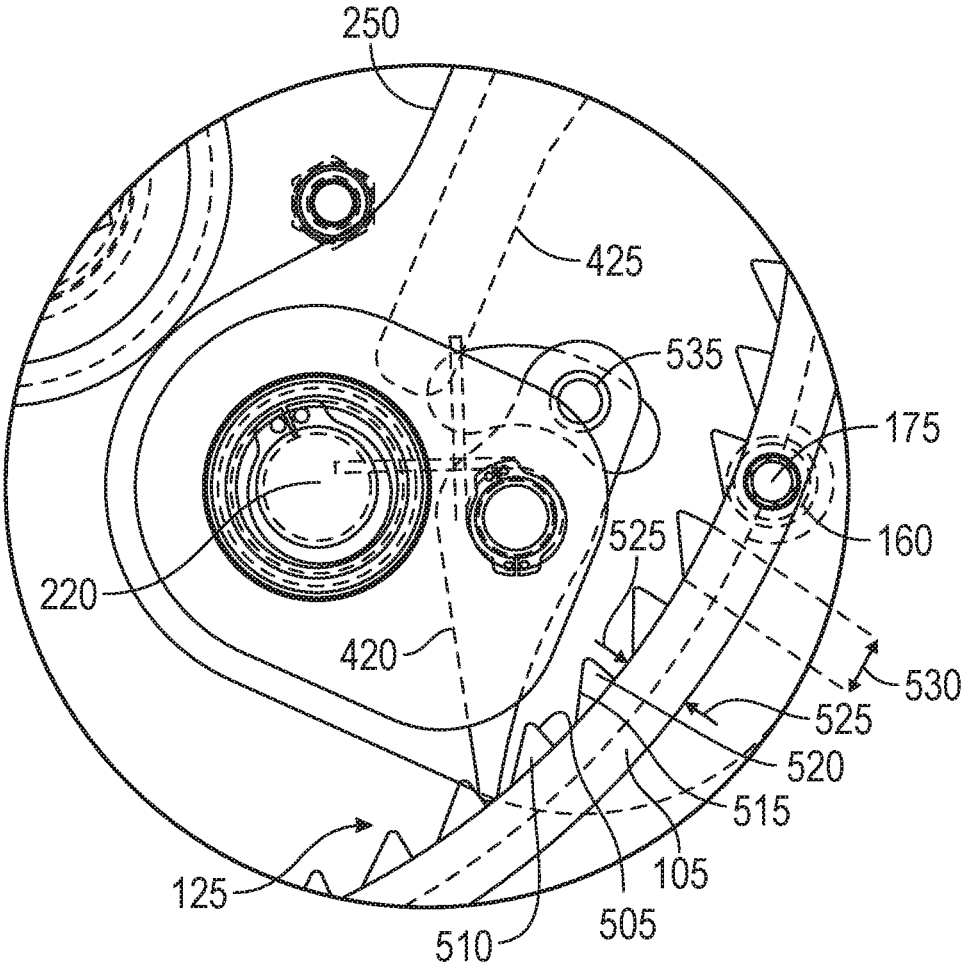
FIG. 5 shows a bender system.

FIG. 5 shows the engagement between ratchet pawl 420 and plurality of ratchet teeth 125 in more detail. As shown in FIG. 5, ratchet pawl 420 may bite against a steep edge 505 of a first ratchet tooth 510 of plurality of ratchet teeth 125 on the downward stroke of handle 250 from position "A" to position "B". As handle 250 moves back toward position "A" from position "B", ratchet pawl 420 may slide over a long edge 515 of a second ratchet tooth 520 of plurality of ratchet teeth 125. Consistent with embodiments of the disclosure, ratcheting gear 105 may have a thickness 525 of 0.235 +/−0.1 inches. Also, each of plurality of ratchet teeth 125 may have a base width 530 of 0.386 inches +/−0.1 inches.

Handle assembly 215 may further include a ratchet release pin 535. Ratchet release pin 535 may be attached to ratchet pawl 420 and may extend back to ratchet release lever 425. Ratchet release lever 425 may push on ratchet release pin 535 to rotate ratchet pawl 420 to disengage ratchet pawl 420 from plurality of ratchet teeth 125.

Figure 6A:
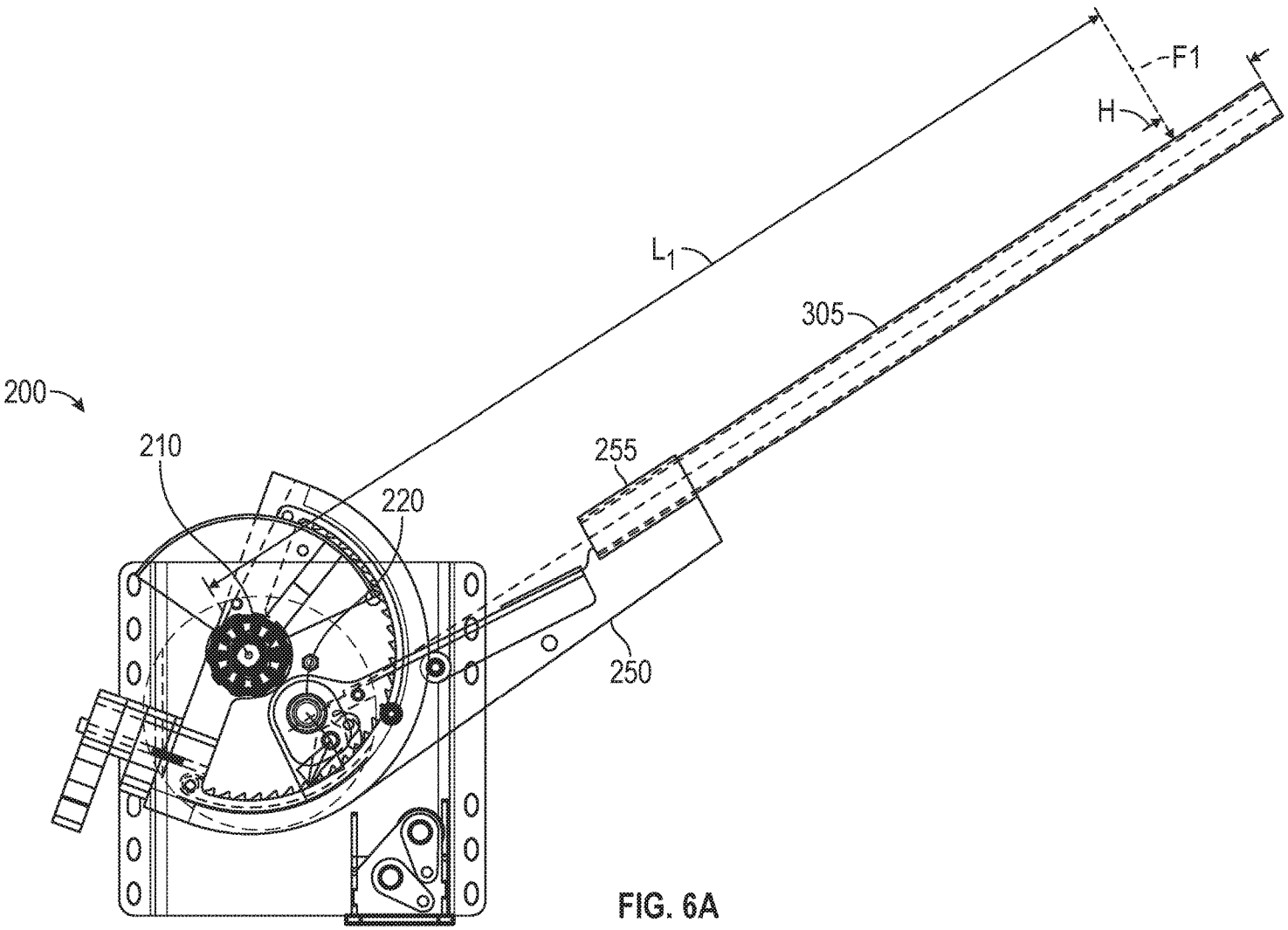
FIG. 6A and FIG. 6B illustrate the mechanical advantage of the bender system.
Figure 6B:
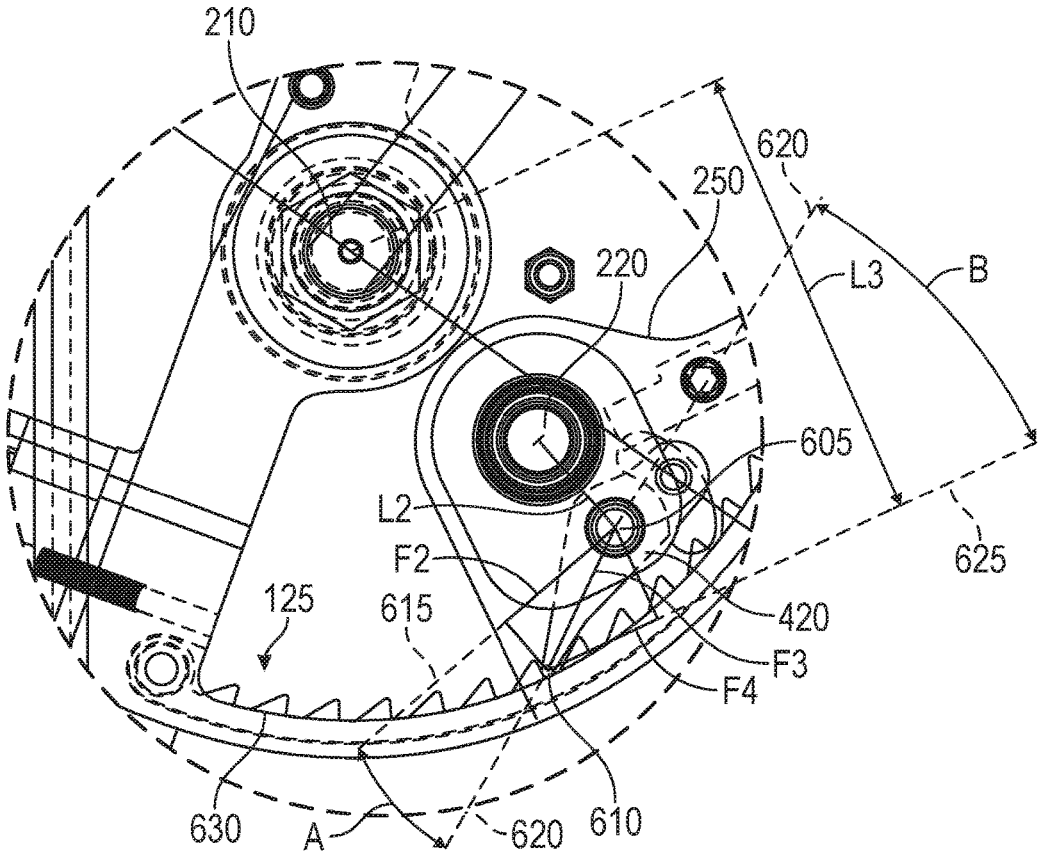

FIG. 6A and FIG. 6B illustrate the mechanical advantage of bender system 200. As shown in FIG. 6A, lever 305 may be placed in lever attachment 255. Accordingly, length L1 may exist from the center of handle pivot 210 to a point at an opposite end of lever 305. A user may exert a force F1 a distance H from the opposite end of lever 305 perpendicular to lever 305. Because the user's hand may be applying force F1, force F1 may be applied distance H from the opposite end of lever 305. Accordingly, a moment M1 may be applied at the center of handle pivot 210 where M1=L1×F1. Consistent with embodiments of the disclosure, L1 may range between 36.0 inches and 60.0 inches.

As shown in FIG. 6B, ratchet pawl 420 may pivot on a ratchet pawl pivot 605. Ratchet pawl 420 may comprise a ratchet pawl tip 610. A length L2 may comprise the distance between the center of handle pivot 220 and the center of ratchet pawl pivot 605. Force F1 may result in a force F2 that may comprise a force at ratchet pawl pivot 605, perpendicular to length L2 where F2=M1/L2. Length L2 may comprise, but is not limited to, 1.25 inches. Length L2 may be within a range between 0.75 inches and 3.0 inches, for example.

Force F2 may be resolved to obtain a force F3 that may comprise a resultant force vector at ratchet pawl tip 610 where F3=F2/Cosine (Angle A). Force F3 may be applied to a steep edge of one of one of plurality of ratchet teeth 125. Angle A may comprise an angle between a first line 615 and a second line 620. First line 615 may comprise a line perpendicular to a line passing through the centers of handle pivot 220 and ratchet pawl pivot 605. Second line 620 may comprise a line passing through ratchet pawl tip 610 and the center of ratchet pawl pivot 605. Angle A may comprise, but is not limited to, 23.8 degrees. Angle A may be within a range between 21 degrees and 27 degrees.

A third line 625 may be tangent to circular interior surface 630 of ratcheting gear 105. A force F4 may be applied to a steep edge of one of one of plurality of ratchet teeth 125 by ratchet pawl tip 610. Force F4 may be parallel to third line 625 and may be resolved from force F3 where F4=F3/Cosine (Angle B). Angle B may comprise an angle between second line 620 and third line 625. Angle B may comprise, but is not limited to, 39.6 degrees. Angle B may be within a range between 35 degrees and 43 degrees.

L3 may comprise the length of a line perpendicular to third line 625 and passing through the center of handle pivot 210. Length L3 may comprise, but is not limited to, 4.94 inches. Length L3 may be within a range between 3.0 inches and 12.0 inches. A final moment M2 may comprise a moment applied at bender shoe pivot 210 where M2=F4× L3. Accordingly, handle assembly 215 may provide bender system 200 with significant mechanical advantage amplifying force F1 to force F4. As can be seen from the above description, length L2 affects the aforementioned amplification, the greater length L2 is, the greater the mechanical advantage. The moment applied at handle pivot 220 may be multiplied by a factor of 4.35 at bender shoe pivot 210 to provide an overall mechanical advantage of 4.35:1, for example. The overall mechanical advantage may range from 2:1 to 10:1, for example. Consequently, for a given L1 (which may be a function of the length of lever 305), L2 and L3 may be optimized to provide an overall mechanical advantage of greater than 4.0.

Figure 7:
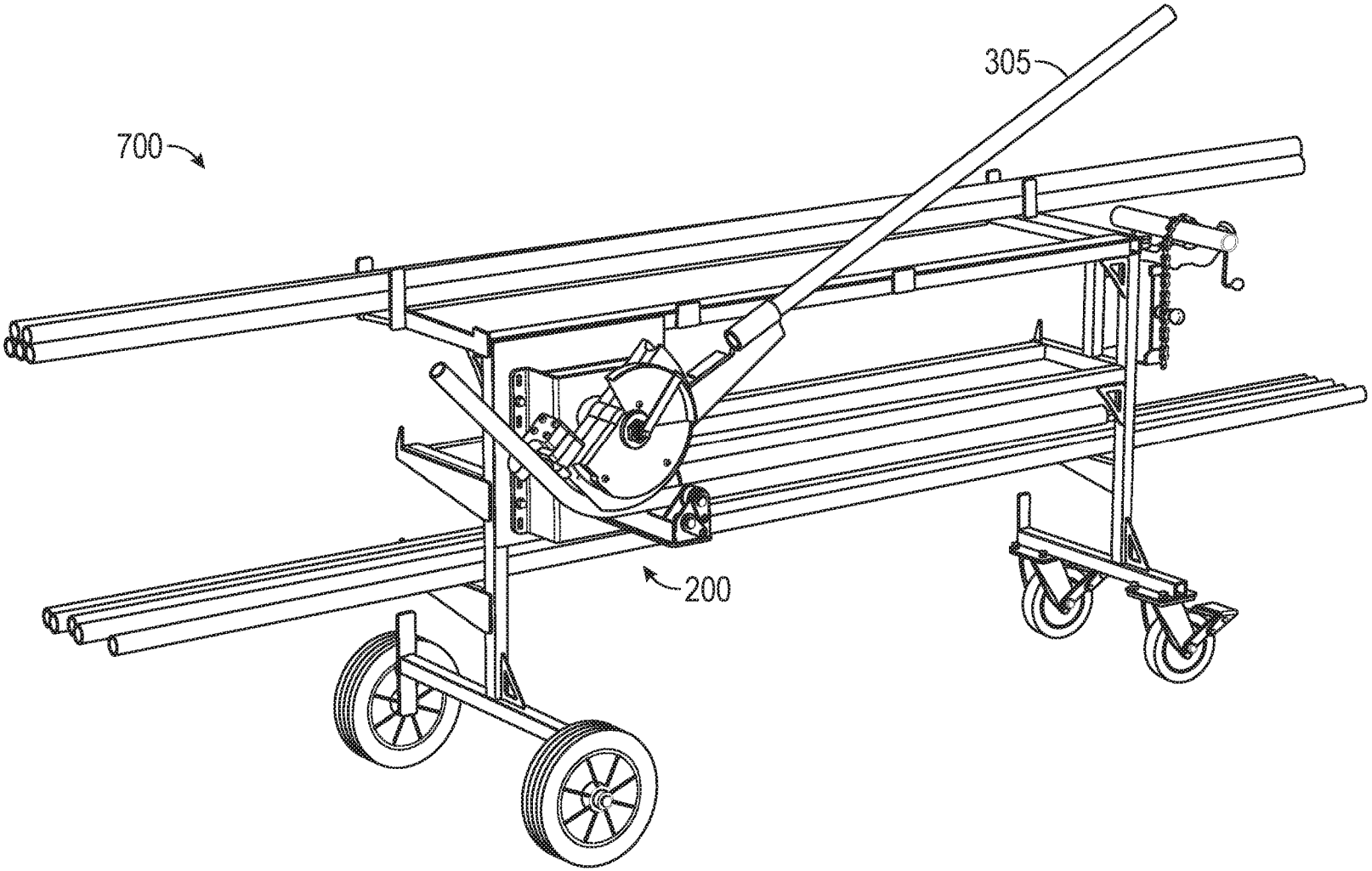
FIG. 7 shows a bender cart.

FIG. 7 shows a bender cart 700 to which bender system 200 may be mounted. Examples of bender cart 700 may be described in U.S. Pat. No. 9,073,108, titled Mobile Conduit Fabrication Work Cart for Jobsite Use, issued on Jul. 7, 2015, the entirety of which is hereby incorporated by reference.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

What is claimed is:

1. A bender shoe comprising:

a plurality of bender shoe plates, wherein the plurality of bender shoe plates comprise a first bender shoe plate, a second bender shoe plate, and a third bender shoe plate wherein a first side of the first bender shoe plate is adjacent to a first side of the second bender shoe plate and the third bender shoe plate is adjacent to a second side of the second bender shoe plate;

a ratcheting gear disposed in a ratcheting gear opening in a second side of the first bender shoe plate;

a first channel formed by a first surface on the first bender shoe plate and a second surface on the second bender shoe plate; and a second channel formed by a third surface on the second bender shoe plate and a fourth surface on the third bender shoe plate.

2. The apparatus of claim 1, wherein the ratcheting gear comprises a plurality of ratchet teeth.

3. The apparatus of claim 1, wherein the ratcheting gear comprises steel plate.

4. The apparatus of claim 1, wherein the ratcheting gear does not comprise cast iron.

5. The apparatus of claim 1, wherein the ratcheting gear comprises a plurality of ratchet teeth wherein each of the plurality of ratchet teeth comprises a steep edge and a long edge.

6. The apparatus of claim 1, wherein the ratcheting gear opening comprises an arc-shaped interior surface adjacent to the ratcheting gear.

7. The apparatus of claim 1, wherein the ratcheting gear comprises a plurality of fasten openings.

8. The apparatus of claim 1, further comprising a plurality of fasteners and wherein the ratcheting gear comprises a plurality of fasten openings, wherein the plurality of fasteners pass through the plurality of fasten openings, the first bender shoe plate, and the second bender shoe plate, and wherein the plurality of fasteners attach to the third bender shoe plate.

9. The apparatus of claim 1, further comprising:

a first bender shoe plate opening disposed in the first bender shoe plate;

a second bender shoe plate opening disposed in the second bender shoe plate; and a third bender shoe plate opening disposed in the third bender shoe plate, wherein the first bender shoe plate opening, the second bender shoe plate opening, and the third bender shoe plate opening are concentric.

10. The apparatus of claim 1, further comprising:

a first bender shoe plate opening disposed in the first bender shoe plate;

a second bender shoe plate opening disposed in the second bender shoe plate;

a third bender shoe plate opening disposed in the third bender shoe plate, wherein the first bender shoe plate opening, the second bender shoe plate opening, and the third bender shoe plate opening are concentric;

a first bushing disposed in the first bender shoe plate opening; and a second bushing disposed in the third bender shoe plate opening.

11. The apparatus of claim 1, further comprising:

a first bender shoe plate opening disposed in the first bender shoe plate;

a third bender shoe plate opening disposed in the third bender shoe plate, wherein the first bender shoe plate opening and the third bender shoe plate opening are concentric;

a first bushing disposed in the first bender shoe plate opening; and a second bushing disposed in the third bender shoe plate opening, wherein the first bushing and the second bushing comprise replaceable filament-wound graphite wear bushings.

12. The apparatus of claim 1, further comprising:

a first bender shoe plate opening disposed in the first bender shoe plate;

a second bender shoe plate opening disposed in the second bender shoe plate;

a third bender shoe plate opening disposed in the third bender shoe plate, wherein the first bender shoe plate opening, the second bender shoe plate opening, and the third bender shoe plate opening are concentric wherein a bender shoe axis passing through the centers of the first bender shoe plate opening, the second bender shoe plate opening, and the third bender shoe plate opening;

a first radius measured from the bottom of the first channel to the bender shoe axis;

a second radius measured from a bottom of the second channel to the bender shoe axis; and a third radius, wherein the ratcheting gear opening comprises an arc-shaped interior surface adjacent to the ratcheting gear, the third radius measured from the arc-shaped interior surface to the bender shoe axis, wherein the first radius is greater than the second radius and the third radius is less than the first radius and greater than the second radius.

13. An apparatus comprising:

a mounting plate;

a bender shoe pivot mounted on the mounting plate;

a bender shoe mounted on the bender shoe pivot, the bender shoe comprising, a plurality of bender shoe plates, wherein the plurality of bender shoe plates comprise a first bender shoe plate, a second bender shoe plate, and a third bender shoe plate wherein a first side of the first bender shoe plate is adjacent to a first side of the second bender shoe plate and the third bender shoe plate is adjacent to a second side of the second bender shoe plate, a ratcheting gear disposed in a ratcheting gear opening in a second side of the first bender shoe plate, a first channel formed by a first surface on the first bender shoe plate and a second surface on the second bender shoe plate, and a second channel formed by a third surface on the second bender shoe plate and a fourth surface on the third bender shoe plate;

a first bender shoe plate opening disposed in the first bender shoe plate;

a second bender shoe plate opening disposed in the second bender shoe plate;

a third bender shoe plate opening disposed in the third bender shoe plate, wherein the first bender shoe plate opening, the second bender shoe plate opening, and the third bender shoe plate opening are concentric wherein a bender shoe axis passing through the centers of the first bender shoe plate opening, the second bender shoe plate opening, and the third bender shoe plate opening;

a first radius measured from the bottom of the first channel to the bender shoe axis;

a second radius measured from a bottom of the second channel to the bender shoe axis;

a third radius, wherein the ratcheting gear opening comprises an arc-shaped interior surface adjacent to the ratcheting gear, the third radius measured from the arc-shaped interior surface to the bender shoe axis, wherein the first radius is greater than the second radius and the third radius is less than the first radius and greater than the second radius;

a handle pivot; and a handle assembly mounted on the handle pivot.

* * * * *